US010057701B2

(12) United States Patent
Jankovsky et al.

(10) Patent No.: US 10,057,701 B2
(45) Date of Patent: Aug. 21, 2018

(54) METHOD OF MANUFACTURING A LOUDSPEAKER

(71) Applicant: Bose Corporation, Framingham, MA (US)

(72) Inventors: Joseph Jankovsky, Holliston, MA (US); Joseph A. Coffey, Jr., Hudson, MA (US); Brendan J. Finnegan, Jamaica Plain, MA (US)

(73) Assignee: Bose Corporation, Framingham, MA (US)

( * ) Notice: Subject to any disclaimer, the term of this patent is extended or adjusted under 35 U.S.C. 154(b) by 567 days.

(21) Appl. No.: 14/674,178

(22) Filed: Mar. 31, 2015

(65) Prior Publication Data

US 2016/0295337 A1 Oct. 6, 2016

(51) Int. Cl.

| | |
|---|---|
| ***H04R 31/00*** | (2006.01) |
| ***H04R 1/28*** | (2006.01) |
| *H04R 1/02* | (2006.01) |
| *H04R 1/34* | (2006.01) |

(52) U.S. Cl.

CPC ..... *H04R 31/00* (2013.01); *H04R 1/288* (2013.01); *H04R 1/023* (2013.01); *H04R 1/345* (2013.01)

(58) Field of Classification Search

None

See application file for complete search history.

(56) References Cited

U.S. PATENT DOCUMENTS

| | | | |
|---|---|---|---|
| 582,147 | A | 5/1897 | Riley |
| 1,387,490 | A | 8/1921 | Humes |
| 1,577,880 | A | 3/1926 | Stuart |
| 1,755,636 | A | 4/1930 | Dubilier |
| 1,840,992 | A | 1/1932 | Weitling |
| 2,225,312 | A | 12/1940 | Mason |
| 2,293,181 | A | 8/1942 | Terman |
| 2,318,535 | A | 5/1943 | Spivak |
| 2,566,094 | A | 8/1951 | Olson et al. |
| 2,739,659 | A | 3/1956 | Daniels |

(Continued)

FOREIGN PATENT DOCUMENTS

| | | | |
|---|---|---|---|
| DE | 19703311 | A1 | 8/1998 |
| EP | 0608937 | A1 | 8/1994 |

(Continued)

OTHER PUBLICATIONS

Meier, et al.; Ein linienhafter akustischer Gruppenstrahler mit ausgeglichenen Nebenmaxima, Acustica vol. 17 1966, pp. 301-309.

(Continued)

*Primary Examiner* — Barbara J Musser

(74) *Attorney, Agent, or Firm* — Brian M. Dingman; Dingman IP Law, PC

(57) ABSTRACT

A method for manufacturing a loudspeaker includes creating a dual-layered fabric having an acoustic resistance by attaching a first fabric having a first acoustic resistance to a second fabric having a second acoustic resistance lower than the first acoustic resistance. The method further includes applying a coating material to a first portion of the dual-layered fabric. The coating material forms a pattern on the first portion of the dual-layered fabric that changes the acoustic resistance of the dual-layered fabric along at least one of: a length and radius of the dual-layered fabric.

28 Claims, 6 Drawing Sheets

(56) References Cited

U.S. PATENT DOCUMENTS 2,789,651 A 4/1957 Daniels
2,856,022 A 10/1958 Kurtze et al.
2,913,680 A 11/1959 Porter et al.
2,939,922 A 6/1960 Gorike
3,174,578 A 3/1965 Kojima
3,378,814 A 4/1968 Butler
3,381,773 A 5/1968 Schenkel
3,486,578 A 12/1969 Albariono
3,517,390 A 6/1970 Whitehead
3,555,956 A 1/1971 Martin
3,657,490 A 4/1972 Scheiber
3,768,589 A 10/1973 Nilsson
3,930,560 A 1/1976 Carlson et al.
3,940,576 A 2/1976 Schultz
3,944,757 A 3/1976 Tsukamoto
3,978,941 A 9/1976 Siebert
4,171,734 A 10/1979 Peveto et al.
4,251,686 A 2/1981 Sokolich
4,297,538 A 10/1981 Massa
4,340,778 A 7/1982 Cowans et al.
4,340,787 A 7/1982 Gorike
4,373,606 A 2/1983 Clements et al.
4,421,957 A 12/1983 Wallace, Jr.
4,546,459 A 10/1985 Congdon
4,586,194 A 4/1986 Kohashi et al.
4,616,731 A 10/1986 Robinson
4,628,528 A 12/1986 Bose et al.
4,646,872 A 3/1987 Kamon et al.
4,706,295 A 11/1987 Putnam et al.
4,747,142 A 5/1988 Tofte
4,757,546 A 7/1988 Akino
4,930,596 A 6/1990 Saiki et al.
4,942,939 A 7/1990 Harrison
4,965,776 A 10/1990 Mueller
5,012,890 A 5/1991 Nagi et al.
5,022,486 A 6/1991 Miura et al.
5,105,905 A 4/1992 Rice
5,109,422 A 4/1992 Furukawa
5,137,110 A 8/1992 Bedard, Jr. et al.
5,170,435 A 12/1992 Rosen et al.
5,187,333 A 2/1993 Adair
5,197,100 A 3/1993 Shiraki
5,197,103 A 3/1993 Hayakawa
5,261,006 A 11/1993 Nieuwendijk et al.
5,276,740 A 1/1994 Inanaga et al.
5,280,229 A 1/1994 Faude et al.
5,325,435 A 6/1994 Date et al.
5,373,564 A 12/1994 Spear et al.
5,375,564 A 12/1994 Gail
5,426,702 A 6/1995 Aarts
5,524,062 A 6/1996 Oh
5,528,694 A 6/1996 Van De Kerkhof et al.
5,610,992 A 3/1997 Hickman
5,673,329 A 9/1997 Wiener
5,732,145 A 3/1998 Tsao et al.
5,740,259 A 4/1998 Dunn
5,744,761 A * 4/1998 Ogura ..... H04R 7/125 181/167
5,792,000 A 8/1998 Weber et al.
5,793,000 A 8/1998 Sabato et al.
5,802,194 A 9/1998 Yamagishi et al.
5,809,153 A 9/1998 Aylward et al.
5,815,589 A 9/1998 Wainwright et al.
5,821,471 A 10/1998 McCuller
5,828,759 A 10/1998 Everingham
5,832,099 A 11/1998 Wiener
5,854,450 A 12/1998 Kent
5,864,100 A 1/1999 Newman
5,870,484 A 2/1999 Greenberger
5,881,989 A 3/1999 O'Brien et al.
5,898,137 A 4/1999 Saito
5,929,392 A 7/1999 Sabato et al.
5,940,347 A 8/1999 Raida et al.
5,956,411 A 9/1999 Edgar
6,002,781 A 12/1999 Takayama et al.
6,005,952 A 12/1999 Klippel
6,067,362 A 5/2000 Lemanski et al.
6,075,868 A 6/2000 Goldfarb et al.
6,144,751 A 11/2000 Velandia
6,158,902 A 12/2000 Staat
6,173,064 B1 1/2001 Anagnos
6,223,853 B1 5/2001 Huon et al.
6,255,800 B1 7/2001 Bork
6,275,595 B1 8/2001 Lundgren et al.
6,278,789 B1 8/2001 Potter
6,356,643 B2 3/2002 Yamagishi et al.
6,359,994 B1 3/2002 Markow et al.
6,374,120 B1 4/2002 Krauss
6,411,718 B1 6/2002 Danley et al.
6,415,036 B1 7/2002 Ritter et al.
6,431,309 B1 8/2002 Coffin
6,477,042 B1 11/2002 Allgeyer et al.
6,597,794 B2 7/2003 Cole et al.
6,694,200 B1 2/2004 Naim
6,704,425 B1 3/2004 Plummer
6,741,717 B2 5/2004 Dedieu et al.
6,744,903 B1 6/2004 Jeon et al.
6,771,787 B1 8/2004 Hoefler et al.
6,820,431 B2 11/2004 McManus et al.
6,870,933 B2 3/2005 Roovers
6,928,169 B1 8/2005 Aylward
6,963,647 B1 11/2005 Krueger et al.
7,016,501 B1 3/2006 Aylward et al.
7,155,214 B2 12/2006 Struthers et al.
7,212,467 B2 5/2007 Dobbins et al.
7,283,634 B2 10/2007 Smith
7,426,280 B2 9/2008 Aylward
7,490,044 B2 2/2009 Kulkarni
7,536,024 B2 5/2009 Bailey et al.
7,542,815 B1 6/2009 Berchin
7,623,670 B2 11/2009 Hoefler et al.
7,747,033 B2 6/2010 Uchimura
7,751,582 B2 7/2010 Akino
D621,439 S 8/2010 Hamanaga
7,826,633 B2 11/2010 Davi
7,833,282 B2 11/2010 Mandpe
7,835,537 B2 11/2010 Cheney
7,848,535 B2 12/2010 Akino
8,066,095 B1 11/2011 Bromer
8,175,311 B2 5/2012 Aylward
8,351,630 B2 1/2013 Ickler et al.
8,447,055 B2 5/2013 Jankovsky et al.
2001/0001319 A1 5/2001 Beckert et al.
2001/0031059 A1 10/2001 Borgonovo
2001/0039200 A1 11/2001 Azima et al.
2002/0073252 A1 6/2002 Arbiter et al.
2002/0085730 A1 7/2002 Holland
2002/0085731 A1 7/2002 Aylward
2002/0115480 A1 8/2002 Huang
2002/0150261 A1 10/2002 Moeller et al.
2002/0171567 A1 11/2002 Altare et al.
2002/0194897 A1 12/2002 Arnott et al.
2003/0063767 A1 4/2003 Dedieu et al.
2003/0095672 A1 5/2003 Hobelsberger
2003/0164820 A1 9/2003 Kent
2004/0105559 A1 6/2004 Aylward et al.
2004/0173175 A1 9/2004 Kostun et al.
2004/0204056 A1 10/2004 Phelps
2004/0234085 A1 11/2004 Lennox
2005/0013457 A1 1/2005 Sheplak et al.
2005/0018839 A1 1/2005 Weiser
2005/0036642 A1 2/2005 Hoefler et al.
2005/0078831 A1 4/2005 Irwan et al.
2005/0205348 A1 9/2005 Parker et al.
2005/0205349 A1 9/2005 Parker et al.
2005/0239434 A1 10/2005 Marlowe
2005/0254681 A1 11/2005 Bailey et al.
2005/0255895 A1 11/2005 Lee et al.
2006/0013411 A1 1/2006 Lin
2006/0046778 A1 3/2006 Hembree
2006/0046780 A1 3/2006 Subramaniam et al.
2006/0065479 A1 3/2006 Okawa et al.
2006/0134959 A1 6/2006 Ellenbogen
2006/0181840 A1 8/2006 Cvetko

(56) References Cited

U.S. PATENT DOCUMENTS

| | | | | |
|---|---|---|---|---|
| 2006/0222196 | A1 | 10/2006 | Uchimura | |
| 2006/0250764 | A1 | 11/2006 | Howarth et al. | |
| 2006/0253879 | A1 | 11/2006 | Lin | |
| 2006/0274913 | A1 | 12/2006 | Akino | |
| 2006/0285714 | A1 | 12/2006 | Akino | |
| 2007/0002533 | A1 | 1/2007 | Kogan et al. | |
| 2007/0014426 | A1 | 1/2007 | Sung et al. | |
| 2007/0015486 | A1 | 1/2007 | Marlowe | |
| 2007/0035917 | A1 | 2/2007 | Hotelling et al. | |
| 2007/0036384 | A1 | 2/2007 | Struthers et al. | |
| 2007/0086606 | A1 | 4/2007 | Goodwin | |
| 2007/0086615 | A1 | 4/2007 | Cheney | |
| 2007/0217633 | A1 | 9/2007 | Copeland et al. | |
| 2007/0226384 | A1 | 9/2007 | Robbin et al. | |
| 2007/0233036 | A1 | 10/2007 | Mandpe | |
| 2007/0239849 | A1 | 10/2007 | Robbin et al. | |
| 2007/0247794 | A1 | 10/2007 | Jaffe et al. | |
| 2007/0269071 | A1 | 11/2007 | Hooley | |
| 2007/0286427 | A1 | 12/2007 | Jung et al. | |
| 2008/0152181 | A1 | 6/2008 | Parker et al. | |
| 2008/0232197 | A1 | 9/2008 | Kojima et al. | |
| 2009/0003613 | A1 | 1/2009 | Christensen | |
| 2009/0003639 | A1 | 1/2009 | Aylward | |
| 2009/0007763 | A1* | 1/2009 | Steele | G10H 3/146 84/746 |
| 2009/0016555 | A1 | 1/2009 | Lynnworth | |
| 2009/0157575 | A1 | 6/2009 | Schobben et al. | |
| 2009/0208047 | A1 | 8/2009 | Ngia et al. | |
| 2009/0209304 | A1 | 8/2009 | Ngia et al. | |
| 2009/0214066 | A1 | 8/2009 | Parker et al. | |
| 2009/0225992 | A1 | 9/2009 | Konagai | |
| 2009/0226004 | A1 | 9/2009 | Sorensen | |
| 2009/0252363 | A1 | 10/2009 | Ickler | |
| 2009/0274313 | A1 | 11/2009 | Klein et al. | |
| 2009/0274329 | A1 | 11/2009 | Ickler et al. | |
| 2009/0304189 | A1 | 12/2009 | Vinton | |
| 2009/0323995 | A1 | 12/2009 | Sibbald | |
| 2010/0092019 | A1 | 4/2010 | Hoefler et al. | |
| 2010/0224441 | A1 | 9/2010 | Fujimori et al. | |
| 2010/0260369 | A1 | 10/2010 | Suzuki | |
| 2010/0290630 | A1 | 11/2010 | Berardi et al. | |
| 2011/0026744 | A1 | 2/2011 | Jankovsky et al. | |
| 2011/0028986 | A1 | 2/2011 | Mandpe | |
| 2011/0096950 | A1 | 4/2011 | Rougas et al. | |
| 2011/0206228 | A1 | 8/2011 | Shiozawa et al. | |
| 2011/0219936 | A1 | 9/2011 | Masuda et al. | |
| 2011/0305359 | A1 | 12/2011 | Ikeda et al. | |
| 2012/0039475 | A1 | 2/2012 | Berardi et al. | |
| 2012/0057736 | A1 | 3/2012 | Shiozawa et al. | |
| 2012/0121118 | A1 | 5/2012 | Fregoso et al. | |
| 2012/0121924 | A1* | 5/2012 | Miller | B21D 31/04 428/596 |
| 2012/0237070 | A1 | 9/2012 | Ickler et al. | |

FOREIGN PATENT DOCUMENTS

| | | | |
|---|---|---|---|
| EP | 0624045 | | 11/1994 |
| EP | 1185094 | A2 | 3/2002 |
| EP | 1487233 | A1 | 12/2004 |
| EP | 1527801 | A3 | 5/2005 |
| EP | 1577880 | | 9/2005 |
| EP | 1921890 | A2 | 5/2008 |
| EP | 2099238 | A1 | 9/2009 |
| EP | 2104375 | A2 | 9/2009 |
| FR | 844769 | A | 8/1939 |
| FR | 1359616 | A | 4/1964 |
| FR | 2653630 | A1 | 4/1991 |
| GB | 22965 | | 10/1908 |
| GB | 310493 | A | 1/1930 |
| GB | 631799 | A | 11/1949 |
| GB | 1159613 | A | 7/1969 |
| GB | 2100551 | A | 12/1982 |
| GB | 2432213 | A | 5/2007 |
| JP | 55165097 | A | 12/1980 |
| JP | S63318899 | A | 12/1988 |
| JP | 4-336795 | A | 11/1992 |
| JP | H11234784 | A | 8/1999 |
| JP | 2007037058 | A | 2/2007 |
| WO | 9611558 | A1 | 4/1996 |
| WO | 9820659 | A1 | 5/1998 |
| WO | 9851122 | A1 | 11/1998 |
| WO | 2004075601 | A1 | 9/2004 |
| WO | 2005/104655 | A2 | 11/2005 |
| WO | 2006/130115 | A1 | 12/2006 |
| WO | 2007007083 | A1 | 1/2007 |
| WO | 2007/031703 | A1 | 3/2007 |
| WO | 2007/049075 | A1 | 5/2007 |
| WO | 2007/052185 | A2 | 5/2007 |
| WO | 2009105313 | A1 | 8/2009 |
| WO | 2009134591 | A1 | 11/2009 |

OTHER PUBLICATIONS

Holland, K. R., et al., A Low Cost End-Fire Acoustic Radiator, Institute of Sound and Vibration Research, University of Southampton, Southampton S095NH, UK, J. Audio Eng. Soc., vol. 39, No. 7/8, Jul./Aug. 1991, pp. 540-550.

Reams, et al., The Karlson-Hypex Bass Enclosure, AES, An Audio Engineering Society Preprint, presented at the 57th Convention, May 10-13, 1977, Los Angeles, CA.

Olson, Harry F., Directional Microphones, Journal of the Audio Engineering Society, RCA Laboratories, Princeton, NJ, pp. 420-430.

Poppe, Martin C., The K-Coupler, A New Acoustical-Impedance Transformer, IEEE Transactions on Audio and Electroacoustics, pp. 163-167, Dec. 1966.

Korn, T.S., A Corner Loudspeaker with Coaxial Acoustical Line, Journal of the Audio Engineering Society, vol. 5, No. 3, Jul. 1957, pp. 138-141.

Ramsey, Robert C., A New Cardiod-Line Mircrophone, Audio Engineering Society, NY, NY, Oct. 5-9, 1959.

Shulman, Yuri, Reducing Off-Axis Comb Filter Effects in Highly Directional Microphones, Audio Engineering Society, Presented at the 81st Convention, Los Angeles, CA, Nov. 12-16, 1986.

Purolator Acoustic Porous Metals, Acoustic Media for Aviation Applications, Aerospace Acoustic Materials, Acoustic Media for Helicopters, pp. 1-4, http://www.purolator-facet.com/acoustic.htm, May 1, 2008.

www.altecmm.com, Oct. 2003, inMotion portable audio stereo.

www.pcstats.com, Jun. 21, 2004, NoiseControl Novibes III HDD Isolation.

www.reviews.cnet.com, Jul. 23, 2004, Creative Travel sound.

www.jbl.com, Jul. 23, 2004, Creative Travel Sound.

www.earsc.com, Jun. 28, 2004, Stereo Speaker.

Steve Guttenberg, "Altec Lansing InMotion", Internet Citation (online) Jun. 10, 2004 (downloaded Nov. 11, 2006) URL: http:// reviews .cnet.conn/4505-7869 7-30790793.html.

EP05107420.1 European Search Report dated Nov. 20, 2006.

International Search Report and Written Opinion dated Jul. 15, 2009 for PCT/US2009/039709.

Boone, Marinus, M. et al.; "Design of a Highly Directional Endfire Loudspeaker Array". J. Audio Eng. Doc., vol. 57, No. 5, May 2009. pp. 309-325.

Van Der Wal, Menno, et al.; "Design of Logarithmically Spaced Constant-Directivity Transducer Arrays". J. Audio Eng. Soc., vol. 44, No. 6, Jun. 1996. pp. 497-507.

Ward, Darren B., et al.; "Theory and Design of Broadband Sensor Arrays with Frequency Invariant Far-field Beam Patterns". J. Acounstic Soc. Am. 97 (2), Feb. 1995. pp. 1023-1034.

Moulton Dave, The Center Channel: Unique and Difficult; TV Technology, Published Oct. 5, 2005. Retrieved May 13, 2009 from: http://www.tvtechnology.com/article/11798.

Rubinson Kalman, Music in the Round #4, Stereophile, Published Mar. 2004; Retrieved May 13, 2009 from http://www.stereophile.com/musicintheround/304round/.

(56) References Cited

OTHER PUBLICATIONS

Silva Robert, Surround Sound—What You Need to Know, The History and Basics of Surround Sound, Retrieved May 13, 2009 from http://hometheater.about.com/od/beforeyoubuy/a/surroundsound.htm.
Linkwitz Siegfried, Surround Sound, Linkwitz Lab, Accurate Reproduction and Recording of Auditory Scenes, Revised Publication Jan. 15, 2009. Retreived May 13, 2009 from http://www.linkwitzlab.comisurround_system.htm.
International Search Report and Written Opinion dated Apr. 28, 2009 for PCT/US2009/032241.
Munjal, M. L., Acoustics of Ducts and Mufflers with Application to Exhaust and Ventilation System Design, 1987, pp. 42-152, John Wiley & Sons, New York, NY.
Augspurger, G.L., Loudspeakers on Damped Pipes, J. Audio Eng. Soc., vol. 48, No. 5, May 2000, pp. 424-436, Perception Inc., Los Angeles, CA.
European Examination Report dated Jul. 21, 2008 for EP Appln. No. 02026327.3.
Japanese Office Action dated Feb. 23, 2009 for related JP Application No. H11-250309.
International Preliminary Report on Patentability dated Feb. 18, 2010 for PCT/US2009/032241.
Baily, A. R. "Non-resonant Loudspeaker Enclosure Design", Wireless World, Oct. 1965.
International Preliminary Report on Patentability dated May 19, 2010 for PCT/US2009/032241.
International Preliminary Report on Patentability dated Jul. 16, 2010 for PCT/US2009/039709.
CN OA dated Aug. 27, 2010 for CN Appln. No. 200710089694.0.
Backgrounder; Technical Overview: Zenith/Bose Television Sound System, Summer/Fall 1986, Zenith Electronics Corporation, 1000 Milwaukee Avenue, Glenview, Illinois 60025, 8 pages.
International Search Report and Written Opinion dated Apr. 27, 2011 for PCT/US2011/024674.
International Search Report and Written Opinion dated Nov. 2, 2011 for PCT/US2011/047429.
JP OA dated Dec. 13, 2011 for JP Appln. No. 2010-546815.
English Translation of Abstract for JP Patent 336975, published Nov. 24, 1992.
International Search Report and Written Opinion dated Feb. 3, 2012 for PCT US2011/052347.
Australian Examiner's first report on Australian Patent Application 2009215768, dated Jan. 20, 2012.
Second Chinese Office Action on Chinese Patent Application 200710089694.0, dated Feb. 13, 2012.
First Chinese Office Action dated Dec. 31, 2012 for Chinese Patent Application No. 200980114910.X.
International Preliminary Report on Patentability dated Feb. 21, 2013 for PCT/US2011/047429.
First Chinese Office Action dated Dec. 31, 2012 for Chinese Patent Application No. 200980114910.X (with English translation).
Fourth Chinese Office Action dated Feb. 22, 2013 for Chinese Application No. 200710089694.0.
Harrell, Jefferson, "Constant Beamwidth One-Octave Bandwidth End-Fire Line Array Loudspeakers", JAES vol. 43, No. 7/8, Jul./Aug. 1995.
International Search Report and Written Opinion dated Jun. 24, 2016 for PCT/US2016/024786.
International Search Report and Written Opinion dated May 17, 2017 for PCT/US2016/051271.

* cited by examiner

METHOD OF MANUFACTURING A LOUDSPEAKER

BACKGROUND

This disclosure relates to a method for manufacturing a loudspeaker.

Loudspeakers generally include a diaphragm and a linear motor. When driven by an electrical input signal, the linear motor moves the diaphragm to cause vibrations in air, thereby generating sound. Various techniques have been used to control the directivity and radiation pattern of a loudspeaker, including acoustic horns, pipes, slots, waveguides, and other structures that redirect or guide the generated sound waves. In some of these structures, an opening in the horn, pipe, slot or waveguide is covered with an acoustically resistive material to improve the performance of the loudspeaker over a wider range of frequencies.

SUMMARY

In general, in some aspects a method for manufacturing a loudspeaker includes creating a dual-layered fabric having an acoustic resistance by attaching a first fabric having a first acoustic resistance to a second fabric having a second acoustic resistance lower than the first acoustic resistance. The method further includes applying a coating material to a first portion of the dual-layered fabric. The coating material forms a pattern on the first portion of the dual-layered fabric that changes the acoustic resistance of the dual-layered fabric along at least one of: a length and radius of the dual-layered fabric.

Implementations may include any, all or none of the following features. The first acoustic resistance may be approximately 1,000 Rayls. The first fabric may be a monofilament fabric. The second fabric may be a monofilament fabric. The first fabric may be attached to the second fabric using at least one of: a solvent and an adhesive.

Applying a coating material to a first portion of the dual-layered fabric may include masking a second portion of the dual-layered fabric, the second portion being adjacent to the first portion. Applying a coating material to a first portion of the dual-layered fabric may further include applying the coating material to an unmasked portion of the dual-layered fabric. Applying a coating material to a first portion of the dual-layered fabric may include selectively depositing the coating material to form the pattern on the first portion of the dual-layered fabric. Applying a coating material to a first portion of the dual-layered fabric may include attaching a pre-cut sheet of material to the first portion of the dual-layered fabric. The coating material may include at least one of: paint, an adhesive, and a polymer.

The method may further include thermoforming the dual-layered fabric into at least one of: a spherical shape, a semi-spherical shape, a conical shape, a toroidal shape, and a shape comprising a section of a sphere, cone or toroid.

The method may further include attaching the dual-layered fabric to an acoustic waveguide.

The method may further include attaching an electro-acoustic driver to the acoustic waveguide.

In general, in some aspects a method of manufacturing a loudspeaker includes providing a fabric having an acoustic resistance and applying a coating material to a first portion of the fabric. The coating material forms a pattern on the first portion of the fabric that changes the acoustic resistance of the fabric along at least one of: a length and radius of the fabric.

Implementations may include any, all or none of the following features. The acoustic resistance may be approximately 1,000 Rayls. The fabric may include a monofilament fabric.

Applying a coating material to a first portion of the fabric may include masking a second portion of the fabric, the second portion being adjacent to the first portion. Applying a coating material to a first portion of the fabric may further include applying the coating material to an unmasked portion of the fabric. Applying a coating material to a first portion of the fabric may include selectively depositing the coating material to form the pattern on the first portion of the fabric. Applying a coating material to a first portion of the fabric may include attaching a pre-cut sheet of material to the first portion of the fabric. The coating material may include at least one of: paint, an adhesive, and a polymer.

The method may further include thermoforming the fabric into at least one of: a spherical shape, a semi-spherical shape, a conical shape, a toroidal shape, and a shape comprising a section of a sphere, cone or toroid.

The method may further include attaching the fabric to an acoustic waveguide.

The method may further include attaching an electro-acoustic driver to the acoustic waveguide.

In general, in some aspects a method of manufacturing a loudspeaker includes creating a dual-layered fabric having an acoustic resistance by attaching a first fabric having a first acoustic resistance to a second fabric having a second acoustic resistance lower than the first resistance. The method further includes altering the acoustic resistance of the dual-layered fabric along at least one of: a length and radius of the dual-layered fabric by fusing a first portion of the dual-layered fabric to form a substantially opaque pattern on the first portion of the dual-layered fabric.

Implementations may include any, all or none of the following features. The first acoustic resistance may be approximately 1,000 Rayls. The first fabric and the second fabric may each include a monofilament fabric. The first fabric may be attached to the second fabric using at least one of: a solvent and an adhesive. Fusing a first portion of the dual-layered fabric may include heating the dual-layered fabric.

The method may further include thermoforming the dual-layered fabric into at least one of: a spherical shape, a semi-spherical shape, a conical shape, a toroidal shape, and a shape comprising a section of a sphere, cone or toroid.

The method may further include attaching the dual-layered fabric to an acoustic waveguide.

The method may further include attaching an electro-acoustic driver to the acoustic waveguide.

Implementations may include one of the above and/or below features, or any combination thereof. Other features and advantages will be apparent from the description and the claims.

BRIEF DESCRIPTION OF THE DRAWINGS

For purposes of illustration some elements are omitted and some dimensions are exaggerated. For ease of reference, like reference numbers indicate like features throughout the referenced drawings.

DETAILED DESCRIPTION

Figure 1A:
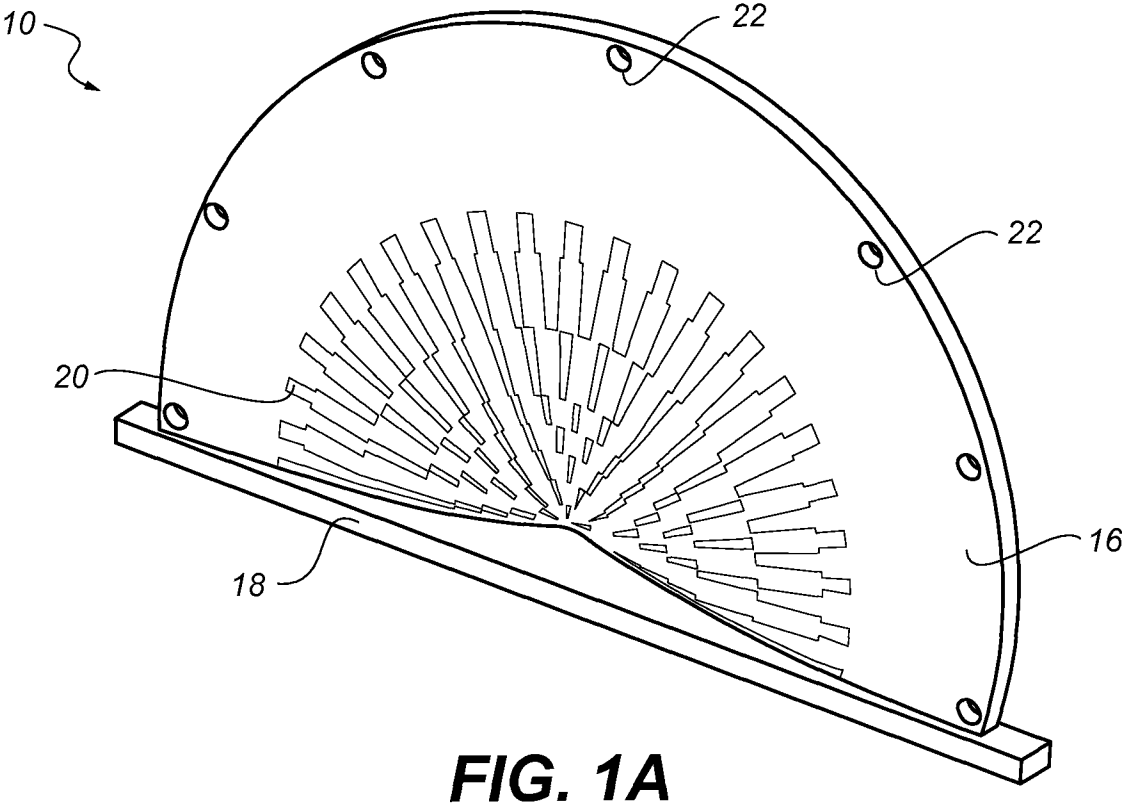
FIG. 1A is perspective view of a loudspeaker.
Figure 1B:
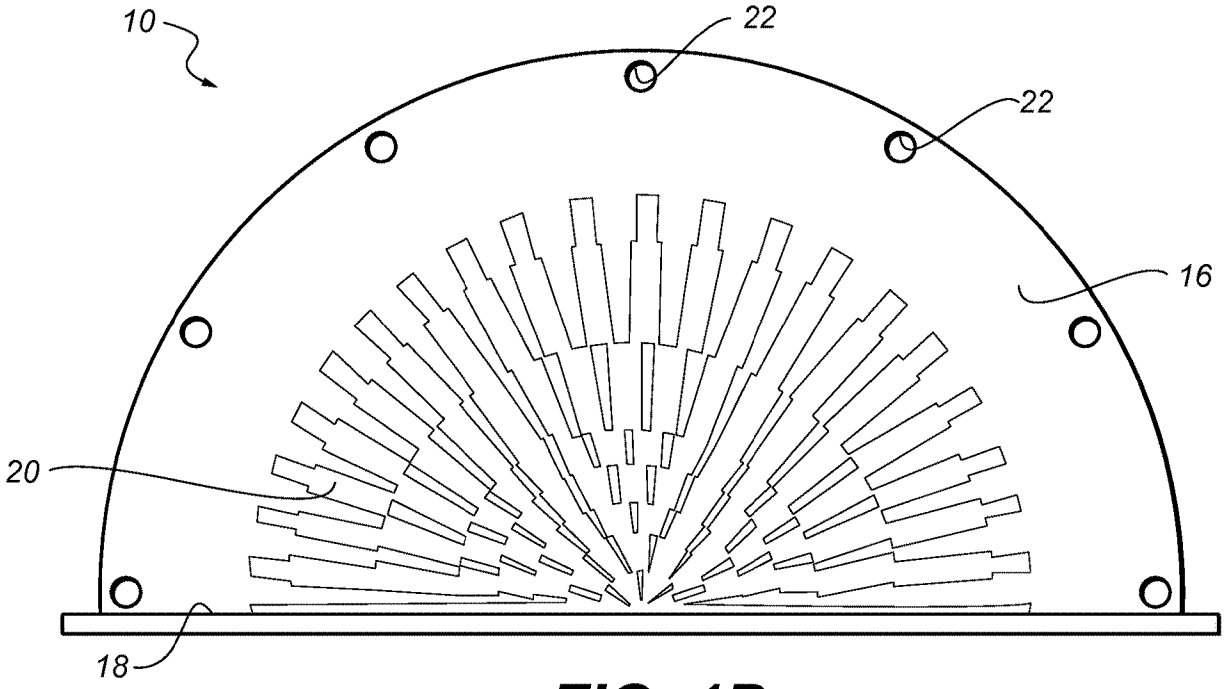
FIG. 1B is front view of the loudspeaker of FIG. 1A.
Figure 1C:
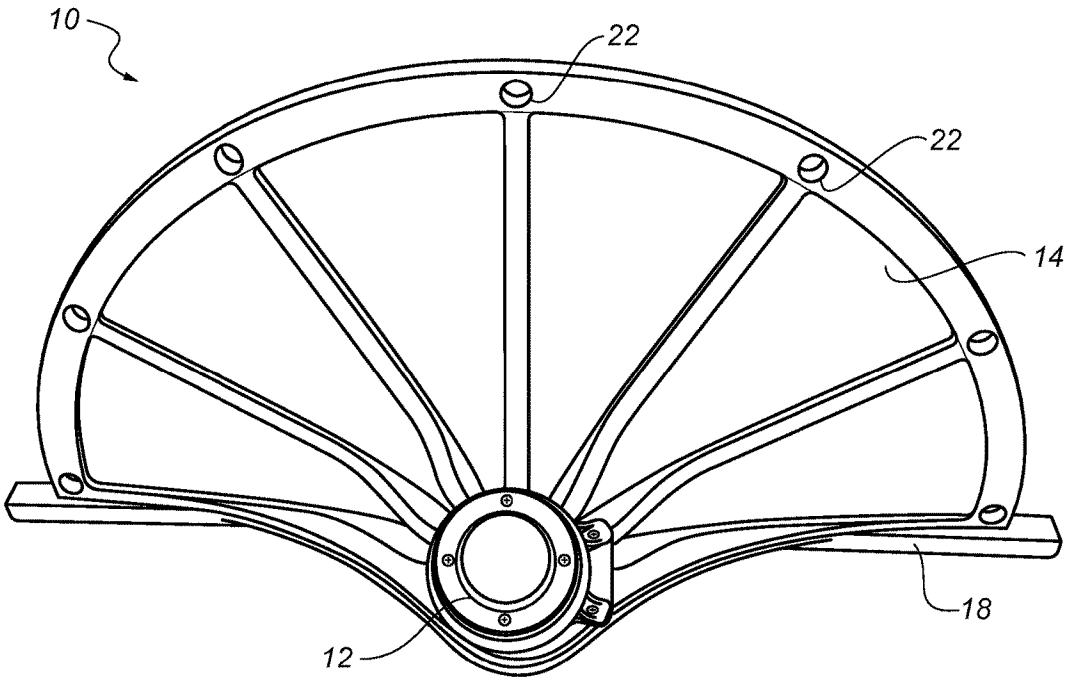
FIG. 1C is a back view of the loudspeaker of FIG. 1A.

A loudspeaker 10, shown in FIGS. 1A through 1C, includes an electro-acoustic driver 12 coupled to an acoustic waveguide 14. The acoustic waveguide 14 is coupled to a resistive screen 16, on which an acoustically resistive pattern 20 is applied. The acoustically resistive pattern 20 may be a substantially opaque and impervious layer that is applied to or generated on the resistive screen 16. The electro-acoustic driver 12, acoustic waveguide 14, and resistive screen 16 together may be mounted onto a base section 18. The base section 18 may be formed integrally with the acoustic waveguide 14 or may be formed separately. The loudspeaker 10 may also include a plurality of mounting holes 22 for mounting the loudspeaker 10 in, for example, a ceiling, wall, or other structure. One such loudspeaker 10 is described in U.S. patent application Ser. No. 14/674,072, titled "Directional Acoustic Device" filed on Mar. 31, 2015, the entire contents of which are incorporated herein by reference.

The electro-acoustic driver 12 typically includes a motor structure mechanically coupled to a radiating component, such as a diaphragm, cone, dome, or other surface. Attached to the inner edge of the cone may be a dust cover or dust cap, which also may be dome-shaped. In operation, the motor structure operates as a linear motor, causing the radiating surface to vibrate along an axis of motion. This movement causes changes in air pressure, which results in the production of sound. The electro-acoustic driver 12 may be a mid-high or high frequency driver, typically having an operating range of 200 Hz to 16 kHz. The electro-acoustic driver 12 may be of numerous types, including but not limited to a compression driver, cone driver, mid-range driver, full-range driver, and tweeter. Although one electro-acoustic driver is shown in FIGS. 1A through 1C, any number of drivers could be used. In addition, the one or more electro-acoustic drivers 12 could be coupled to the acoustic waveguide 14 via an acoustic passage or manifold component, such as those described in U.S. Patent Publication No. 2011-0064247, the entire contents of which are incorporated herein by reference.

The electro-acoustic driver 12 is coupled to an acoustic waveguide 14 which, in the example of FIGS. 1A through 1C, guides the generated sound waves in a radial direction away from the electro-acoustic driver 12. The loudspeaker 10 could be any number of shapes, including but not limited to circular, semi-circular, spherical, semi-spherical, conical, semi-conical, toroidal, semi-toroidal, rectangular, and a shape comprising a section of a circle, sphere, cone, or toroid. In examples where the loudspeaker 10 has a non-circular or non-spherical shape, the acoustic waveguide 14 guides the generated sound waves in a direction away from the electro-acoustic driver 12. The acoustic waveguide 14 may be constructed of a metal or plastic material, including but not limited to thermoset polymers and thermoplastic polymer resins such as polyethylene terephthalate (PET), polypropylene (PP), and polyethylene (PE). Moreover, fibers of various materials, including fiberglass, may be added to the polymer material for increased strength and durability. The acoustic waveguide 14 could have a substantially solid structure, as shown in FIGS. 1A through 1C, or could have hollow portions, for example a honeycomb structure.

Before the generated sound waves reach the external environment, they pass through a resistive screen 16 coupled to an opening in the acoustic waveguide 14. The resistive screen 16 may include one or more layers of a mesh material or fabric. In some examples, the one or more layers of material or fabric may each be made of monofilament fabric (i.e., a fabric made of a fiber that has only one filament, so that the filament and fiber coincide). The fabric may be made of polyester, though other materials could be used, including but not limited to metal, cotton, nylon, acrylic, rayon, polymers, aramids, fiber composites, and/or natural and synthetic materials having the same, similar, or related properties, or a combination thereof. In other examples, a multifilament fabric may be used for one or more of the layers of fabric.

In one example, the resistive screen 16 is made of two layers of fabric, one layer being made of a fabric having a relatively high acoustic resistance compared to the second layer. For example, the first fabric may have an acoustic resistance ranging from 200 to 2,000 Rayls, while the second fabric may have an acoustic resistance ranging from 1 to 90 Rayls. The second layer may be a fabric made of a coarse mesh to provide structural integrity to the resistive screen 16, and to prevent movement of the screen at high sound pressure levels. In one example, the first fabric is a polyester-based fabric having an acoustic resistance of approximately 1,000 Rayls (e.g., Saatifil® Polyester PES 10/3 supplied by Saati of Milan, Italy) and the second fabric is a polyester-based fabric made of a coarse mesh (e.g., Saatifil® Polyester PES 42/10 also supplied by Saati of Milan, Italy). In other examples, however, other materials may be used. In addition, the resistive screen 16 may be made of a single layer of fabric or material, such as a metal-based mesh or a polyester-based fabric. And in still other examples, the resistive screen 16 may be made of more than two layers of material or fabric. The resistive screen 16 may also include a hydrophobic coating to make the screen water-resistant.

The resistive screen 16 also includes an acoustically resistive pattern 20 that is applied to or generated on the surface of the resistive screen 16. The acoustically resistive pattern 20 may be a substantially opaque and impervious layer. Thus, in the places where the acoustically resistive pattern 20 is applied, it substantially blocks the holes in the mesh material or fabric, thereby creating an acoustic resistance that varies as the generated sound waves move radially outward through the resistive screen 16 (or outward in a linear direction for non-circular and non-spherical shapes). For example, where the acoustic resistance of the resistive screen 16 without the acoustically resistive pattern 20 is approximately 1,000 Rayls over a prescribed area, the acoustic resistance of the resistive screen 16 with the acoustically resistive pattern 20 may be approximately 10,000 Rayls over an area closer to the electro-acoustic driver 12, and approximately 1,000 Rayls over an area closer to the edge of the loudspeaker 10 (e.g., in areas that do not include the acoustically resistive pattern 20). The size, shape, and thickness of the acoustically resistive pattern 20 may vary, and just one example is shown in FIGS. 1A through 1C.

The material used to generate the acoustically resistive pattern 20 may vary depending on the material or fabric used for the resistive screen 16. In the example where the resistive screen 16 comprises a polyester fabric, the material used to generate the acoustically resistive pattern 20 may be paint (e.g., vinyl paint), or some other coating material that is compatible with polyester fabric. In other examples, the material used to generate the acoustically resistive pattern 20 may be an adhesive or a polymer. In still other examples, rather than add a coating material to the resistive screen 16, the acoustically resistive pattern 20 may be generated by transforming the material comprising the resistive screen 16, for example by heating the resistive screen 16 to selectively fuse the intersections of the mesh material or fabric, thereby substantially blocking the holes in the material or fabric.

Figure 2:
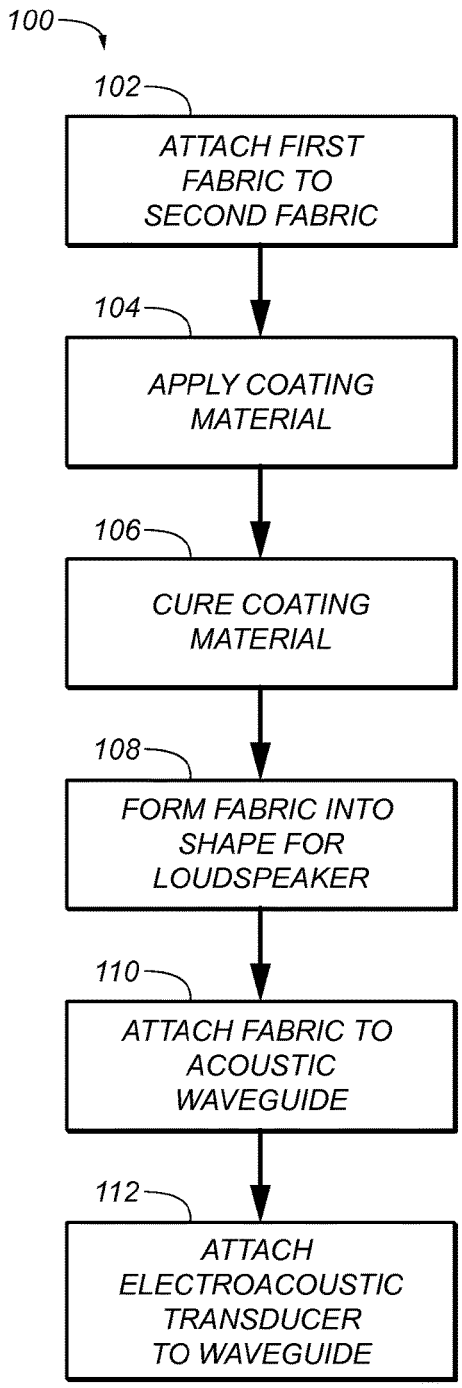
FIG. 2 shows a flow chart of a method for manufacturing the loudspeaker of FIGS. 1A through 1C.

FIG. 2 shows a flow chart of a method 100 for manufacturing the loudspeaker 10 of FIGS. 1A through 1C in the example where the resistive screen 16 is made of two layers of fabric, and a coating material is applied to the resistive screen 16 to form the acoustically resistive pattern 20. Although steps 102-112 of FIG. 2 are shown as occurring in a certain order, it should be readily understood that the steps 102-112 could occur in a different order than is shown. Moreover, although steps 102-112 of FIG. 2 are shown as occurring separately, it should be readily understood that certain of the steps could be combined and occur at the same time. As shown in FIG. 2, to begin formation of the resistive screen 16, a first fabric is attached to a second fabric in step 102. The two fabrics may be attached by, for example, using a layer of solvent, adhesive, or glue that joins the two layers of fabric. Alternatively, the fabrics may be heated to a temperature that permits the two fabrics to be joined to each other. For example, the fabrics may be placed in mold that heats the fabrics to a predetermined temperature for a predetermined length of time until the fabrics adhere to each other, or a laser (or other heat-applying apparatus) may be used to selectively apply heat to portions of the fabrics until those portions adhere to each other. Alternatively, the fabrics could be joined by thermoforming, pressure forming and/or vacuum forming the fabrics.

Figure 6:
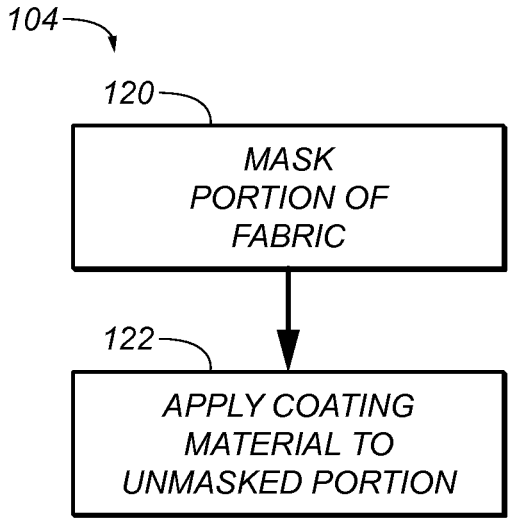
FIG. 6 shows a flow chart of a step that may be used in the methods for manufacturing shown in FIGS. 2 and 3.

In step 104, a coating material (such as paint, an adhesive or a polymer) is applied to the resistive screen 16 to form the acoustically resistive pattern 20. In one example, as shown in FIG. 6, the coating material could be applied using a mask. In that example, a portion of the fabric could be masked (in step 120), and the coating material could be applied to the unmasked portion of the fabric (in step 122), by, for example, spraying or otherwise depositing the coating material onto the unmasked portion of the fabric. In some examples, after the mask has been applied, a coating material (e.g., adhesive beads or polymer beads) could be deposited on the unmasked portion of the fabric, and then melted onto the fabric via the application of heat. The coating material could be applied to the resistive screen 16 using other methods besides a mask, however. For example, the coating material could be pre-cut (for example, using a laser cutter or die cutter), and could then be ironed-on to the fabric or attached using an adhesive. For example, the coating material could comprise a sheet of polymer plastic, metal, paper, or any substantially opaque material having the same, similar, or related properties (or any combination thereof) that is pre-cut into the desired acoustically resistive pattern 20. The sheet could then be attached to the fabric via the application of heat or an adhesive. In yet another example, the coating material could be deposited directly onto the fabric, using a machine that can draw out the desired pattern 20, thereby selectively applying the coating material only to the portion of the fabric that should have the acoustically resistive pattern 20. In addition, the coating material could be applied to the resistive screen 16 using other known methods, including but not limited to a silk-screen, spray paint, ink jet printing, etching, melting, electrostatic coating, or any combination thereof.

Optionally, in step 106, the coating material may be cured, by, for example, baking the assembly at a predetermined temperature, applying ultraviolet (UV) light to the coating material, exposing the coating material to the air, or any combination thereof. If a coating material is selected that does not need to be cured, step 106 would be omitted. In some examples, steps 102, 104 and 106 could be combined into a single step. For example, the first and second layers of fabric could be placed on top of each other, and a UV-curable adhesive could be deposited onto one layer of the fabric in the desired acoustically resistive pattern 20. The adhesive could then be cured via the application of UV light, which would also result in adhering the two layers of fabric.

In step 108, the fabric is formed into the desired shape for the loudspeaker 10. For example, the fabric may be formed to be a semi-circle, circle, sphere, semi-sphere, rectangle, cone, toroid, or a shape comprising a section of a circle, sphere, cone, toroid and/or rectangle. The loudspeaker 10 may also be bent and/or curved along its length, as described, for example, in U.S. Pat. No. 8,351,630, the entire contents of which are incorporated herein by reference. These various shapes may be created by thermoforming the fabric (i.e., heating it to a pliable forming temperature and then forming it to a specific shape in a mold) and/or vacuum or pressure forming the fabric. Although FIG. 2 shows step 108 as occurring after the coating material has been applied to the resistive screen 16, in other examples, the fabric could be formed into the desired shape before the coating material is applied. Moreover, step 108 could be combined with step 102, so that the forming process also joins the two layers of fabric.

In step 110, the resistive screen 16 is attached to the acoustic waveguide 14 via an adhesive, double-sided tape, a fastener (e.g., a screw, bolt, clamp, clasp, clip, pin or rivet), or other known methods. And in step 112, the electro-acoustic driver 12 is attached to the acoustic waveguide 14. The electro-acoustic driver 12 could be secured to the acoustic waveguide 14 via a fastener or other known methods. Although FIG. 2 shows step 112 as occurring after the fabric has been attached to the acoustic waveguide, in other examples, the electro-acoustic transducer could be attached to the waveguide before the fabric is attached. The acoustic waveguide 14 could be constructed via compression molding, injection molding, plastic machining, or other known methods.

Figure 3:
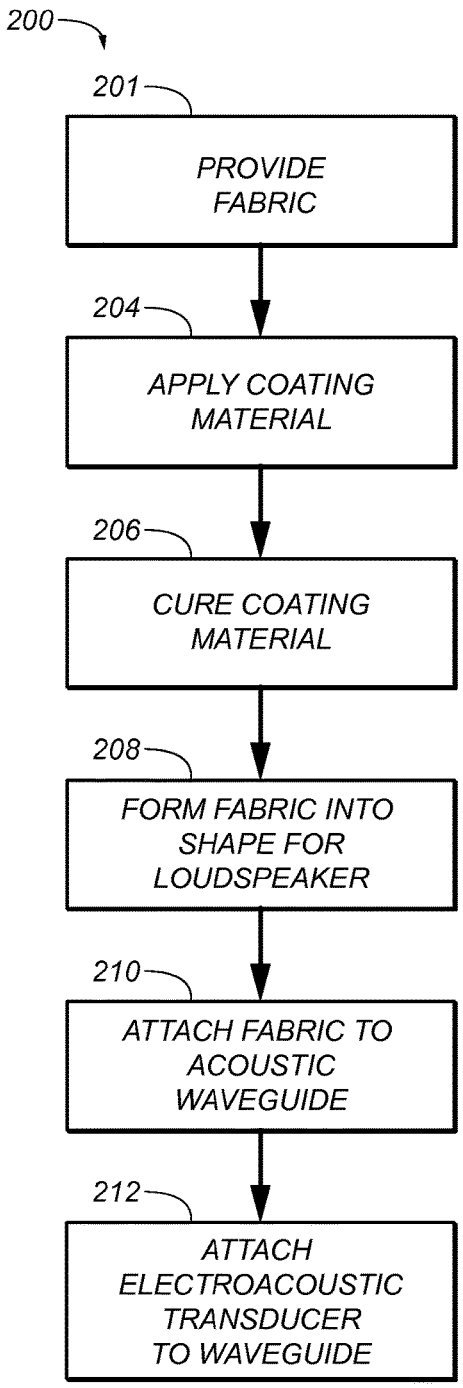
FIG. 3 shows a flow chart of an alternative method for manufacturing the loudspeaker of FIGS. 1A through 1C.

FIG. 3 shows a flow chart of an alternative method 200 for manufacturing the loudspeaker 10 of FIGS. 1A through 1C in the example where the resistive screen 16 is made of a single layer of fabric, and a coating material is applied to the resistive screen 16 to form the acoustically resistive pattern 20. Although steps 201-212 of FIG. 3 are shown as occurring in a certain order, it should be readily understood that the steps 201-212 could occur in a different order than is shown. Moreover, although steps 201-212 of FIG. 2 are shown as occurring separately, it should be readily understood that certain of the steps could be combined and occur at the same time. As shown in FIG. 3, to begin formation of the resistive screen 16, a fabric is provided in step 201. In step 204, a coating material (such as paint, an adhesive or a polymer) is applied to the fabric to form the acoustically resistive pattern 20. The coating material could be applied using the methods previously described in connection with FIG. 2 (e.g., via a mask, a pre-cut sheet of material, by depositing the coating material directly onto the fabric in the desired pattern 20, or via a silkscreen, spray paint, ink jet printing, etching, melting, electrostatic coating, or any combination thereof).

Optionally, in step 206, the coating material may be cured, by, for example, the methods previously described in connection with FIG. 2 (e.g., baking the assembly at a predetermined temperature, applying UV light to the coating material, exposing the coating material to the air, or any combination thereof). If a coating material is selected that does not need to be cured, step 206 would be omitted. As with the example shown in FIG. 2, steps 201, 204 and 206 could be combined into a single step.

In step 208, the fabric is formed into the desired shape for the loudspeaker 10. As with the example of FIG. 2, the fabric may be formed to be a semi-circle, circle, sphere, semi-sphere, rectangle, cone, toroid, or a shape comprising a section of a circle, sphere, cone, toroid and/or rectangle. The loudspeaker 10 may also be bent and/or curved along its length, as described, for example, in U.S. Pat. No. 8,351,630. These various shapes may be created by thermoforming the fabric (i.e., heating it to a pliable forming temperature and then forming it to a specific shape in a mold) and/or vacuum or pressure forming the fabric. Although FIG. 3 shows step 208 as occurring after the coating material has been applied to the resistive screen 16, in other examples, the fabric could be formed into the desired shape before the coating material is applied.

As with the example of FIG. 2, in step 210, the resistive screen 16 is attached to the acoustic waveguide 14 via an adhesive, double-sided tape, a fastener (e.g., a screw, bolt, clamp, clasp, clip, pin or rivet) or other known methods; and in step 212, the electro-acoustic driver 12 is attached to the acoustic waveguide 14 via a fastener or other known methods. Although FIG. 3 shows step 212 as occurring after the fabric has been attached to the acoustic waveguide, in other examples, the electro-acoustic transducer could be attached to the waveguide before the fabric is attached. As with the example of FIG. 2, the acoustic waveguide 14 could be constructed via compression molding, injection molding, plastic machining, or other known methods.

Figure 4:
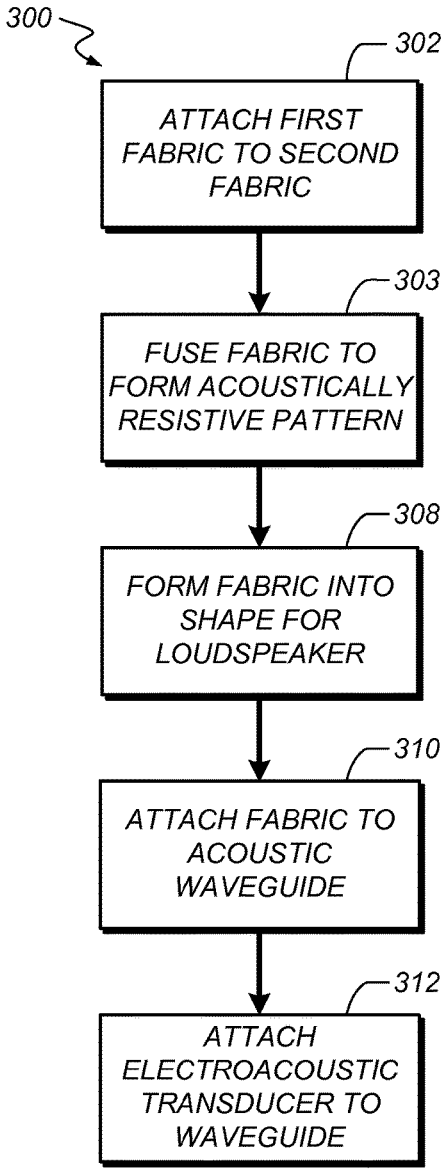
FIG. 4 shows a flow chart of an alternative method for manufacturing the loudspeaker of FIGS. 1A through 1C.

FIG. 4 shows a flow chart of an alternative method 300 for manufacturing the loudspeaker 10 of FIGS. 1A through 1C in the example where the resistive screen 16 is made of two layers of fabric, and the acoustically resistive pattern 20 is formed by fusing the intersections of the fabric, thereby substantially blocking the holes in the fabric. Although steps 302-312 of FIG. 4 are shown as occurring in a certain order, it should be readily understood that the steps 302-312 could occur in a different order than is shown. Moreover, although steps 302-312 of FIG. 4 are shown as occurring separately, it should be readily understood that certain of the steps could be combined and occur at the same time. As shown in FIG. 4, to begin formation of the resistive screen 16, a first fabric is attached to a second fabric in step 302. The first fabric could be attached to the second fabric using the methods previously described in connection with FIG. 2 (e.g., via a layer of solvent, adhesive or glue, or via heating, thermoforming, pressure forming, vacuum forming, or any combination thereof).

In step 303, the fabric is fused to form the acoustically resistive pattern 20, such that the holes in the fabric are substantially blocked, thereby creating a substantially opaque and impervious layer on the fabric. The fabric could be fused by, for example, applying heat to the portions of the fabric that should have the acoustically resistive pattern 20, or by selectively applying chemical bonding elements to the portions of the fabric that should have the acoustically resistive pattern 20.

As with the examples of FIGS. 2 and 3, in step 308, the fabric is formed into the desired shape for the loudspeaker 10 (e.g., via thermoforming, vacuum forming and/or pressure forming); in step 310, the resistive screen 16 is attached to the acoustic waveguide 14; and in step 312, the electro-acoustic driver 12 is attached to the acoustic waveguide 14. These steps could be completed using the methods previously described in connection with FIGS. 2 and 3.

Figure 5:
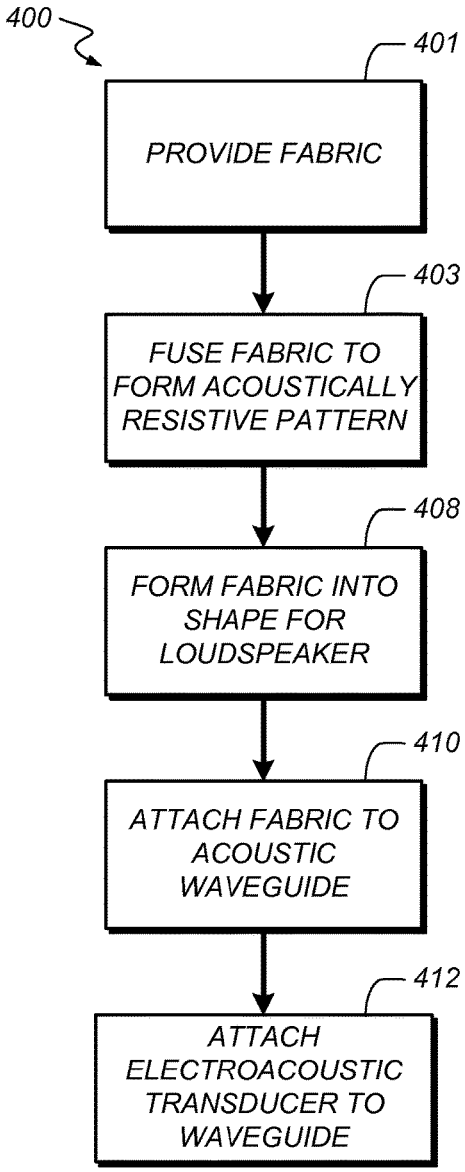
FIG. 5 shows a flow chart of an alternative method for manufacturing the loudspeaker of FIGS. 1A through 1C

FIG. 5 shows a flow chart of an alternative method 400 for manufacturing the loudspeaker 10 of FIGS. 1A through 1C in the example where the resistive screen 16 is made of a single layer of fabric, and the acoustically resistive pattern 20 is formed by fusing the intersections of the fabric, thereby substantially blocking the holes in the fabric. Although steps 401-412 of FIG. 5 are shown as occurring in a certain order, it should be readily understood that the steps 401-412 could occur in a different order than is shown. Moreover, although steps 401-412 of FIG. 5 are shown as occurring separately, it should be readily understood that certain of the steps could be combined and occur at the same time. As shown in FIG. 5, to begin formation of the resistive screen 16, a fabric is provided in step 401.

In step 403, the fabric is fused to form the acoustically resistive pattern 20, such that the holes in the fabric are substantially blocked, thereby creating a substantially opaque and impervious layer on the fabric. The fabric could be fused by, for example, applying heat to the portions of the fabric that should have the acoustically resistive pattern 20, or by selectively applying chemical bonding elements to the portions of the fabric that should have the acoustically resistive pattern 20.

As with the examples of FIGS. 2 through 4, in step 408, the fabric is formed into the desired shape for the loudspeaker 10 (e.g., via thermoforming, vacuum forming and/or pressure forming); in step 410, the resistive screen 16 is attached to the acoustic waveguide 14; and in step 412, the electro-acoustic driver 12 is attached to the acoustic waveguide 14. These steps could be completed using the methods previously described in connection with FIGS. 2 through 4.

A number of implementations have been described. Nevertheless, it will be understood that additional modifications may be made without departing from the scope of the inventive concepts described herein, and, accordingly, other embodiments are within the scope of the following claims.

What is claimed is:

1. A method of manufacturing a loudspeaker comprising:
providing an electroacoustic driver having a diaphragm;
coupling the electroacoustic driver to a first portion of an acoustic waveguide;
providing a resistive screen with a fabric having a length and radius, and an acoustic resistance;
coupling the resistive screen to a second portion of the waveguide;
applying a coating material to a first portion of the fabric, wherein the coating material forms a pattern on the first portion of the fabric that changes the acoustic resistance of the fabric along at least one of the length and radius of the fabric.

2. The method of claim 1, wherein the acoustic resistance is 1,000 Rayls.

3. The method of claim 1, wherein the fabric comprises a monofilament fabric.

4. The method claim 1, wherein applying a coating material to a first portion of the fabric comprises masking a second portion of the fabric, the second portion being adjacent to the first portion.

5. The method of claim 4, wherein applying a coating material to a first portion of the fabric further comprises applying the coating material to an unmasked portion of the fabric.

6. The method of claim 1, wherein applying a coating material to a first portion of the fabric comprises selectively depositing the coating material to form the pattern on the first portion of the fabric.

7. The method of claim 1, wherein applying a coating material to a first portion of the fabric comprises attaching a pre-cut sheet of material to the first portion of the fabric.

8. The method of claim 1, wherein the coating material comprises at least one of: paint, an adhesive, and a polymer.

9. The method of claim 1, further comprising thermoforming the fabric into at least one of: a spherical shape, a semi-spherical shape, a conical shape, a toroidal shape, and a shape comprising a section of a sphere, cone or toroid.

10. A method of manufacturing a loudspeaker comprising:

creating a dual-layered fabric having a length and radius, and an acoustic resistance by attaching a first fabric having a first acoustic resistance to a second fabric having a second acoustic resistance lower than the first resistance;

altering the acoustic resistance of the dual-layered fabric along at least one of the length and radius of the dual-layered fabric, comprising:

fusing a first portion of the dual-layered fabric to form a substantially opaque pattern on the first portion of the dual-layered fabric.

11. The method of claim 10, wherein the first acoustic resistance is in the range of 200 to 2,000 Rayls.

12. The method of claim 10, wherein the first fabric and the second fabric each comprise a monofilament fabric.

13. The method of claim 10, wherein the first fabric is attached to the second fabric using at least one of: a solvent and an adhesive.

14. The method of claim 10, wherein fusing a first portion of the dual-layered fabric comprises heating the dual-layered fabric.

15. The method of claim 10, further comprising thermoforming the dual-layered fabric into at least one of: a spherical shape, a semi-spherical shape, a conical shape, a toroidal shape, and a shape comprising a section of a sphere, cone or toroid.

16. The method of claim 15, further comprising attaching the dual-layered fabric to an acoustic waveguide.

17. The method of claim 16, further comprising attaching an electro-acoustic driver to the acoustic waveguide.

18. A method of manufacturing a loudspeaker comprising:

providing an electroacoustic driver having a diaphragm;

coupling the electroacoustic driver to a first portion of an acoustic waveguide;

creating a resistive screen with a dual-layered fabric having a length and radius, and an acoustic resistance by attaching a first fabric having a first acoustic resistance to a second fabric having a second acoustic resistance lower than the first acoustic resistance;

coupling the resistive screen to a second portion of the waveguide;

applying a coating material to a first portion of the dual-layered fabric, wherein the coating material forms a pattern on the first portion of the dual-layered fabric that changes the acoustic resistance of the dual-layered fabric along at least one of the length and radius of the dual-layered fabric.

19. The method of claim 18, wherein the first acoustic resistance is in the range of 200 to 2,000 approximately 1,000 Rayls.

20. The method of claim 18, wherein the first fabric comprises a monofilament fabric.

21. The method of claim 18, wherein the second fabric comprises a monofilament fabric.

22. The method of claim 18, wherein the first fabric is attached to the second fabric using at least one of: a solvent and an adhesive.

23. The method of claim 18, wherein applying a coating material to a first portion of the dual-layered fabric comprises masking a second portion of the dual-layered fabric, the second portion being adjacent to the first portion.

24. The method of claim 23, wherein applying a coating material to a first portion of the dual-layered fabric further comprises applying the coating material to an unmasked portion of the dual-layered fabric.

25. The method of claim 18, wherein applying a coating material to a first portion of the dual-layered fabric comprises selectively depositing the coating material to form the pattern on the first portion of the dual-layered fabric.

26. The method of claim 18, wherein applying a coating material to a first portion of the dual-layered fabric comprises attaching a pre-cut sheet of material to the first portion of the dual-layered fabric.

27. The method of claim 18, wherein the coating material comprises at least one of: paint, an adhesive, and a polymer.

28. The method of claim 18, further comprising thermoforming the dual-layered fabric into at least one of: a spherical shape, a semi-spherical shape, a conical shape, a toroidal shape, and a shape comprising a section of a sphere, cone or toroid.

* * * * *